US007924252B2

(12) United States Patent
Akai et al.

(10) Patent No.: US 7,924,252 B2
(45) Date of Patent: Apr. 12, 2011

(54) DISPLAY DRIVER

(75) Inventors: Akihito Akai, Yokohama (JP); Yasuyuki Kudo, Fujisawa (JP); Takuya Eriguchi, Yokosuka (JP); Kazuo Okado, Kokubunji (JP)

(73) Assignee: Renesas Electronics Corporation, Kanagawa (JP)

( * ) Notice: Subject to any disclaimer, the term of this patent is extended or adjusted under 35 U.S.C. 154(b) by 1021 days.

(21) Appl. No.: 11/443,224

(22) Filed: May 31, 2006

(65) Prior Publication Data

US 2007/0057884 A1 Mar. 15, 2007

(30) Foreign Application Priority Data

Sep. 9, 2005 (JP) ..... 2005-261924

(51) Int. Cl.
*G09G 3/36* (2006.01)

(52) U.S. Cl. ..... 345/89

(58) Field of Classification Search ..... None
See application file for complete search history.

(56) References Cited

U.S. PATENT DOCUMENTS

| | | | | |
|---|---|---|---|---|
| 6,249,270 | B1 * | 6/2001 | Ito | 345/100 |
| 7,193,637 | B2 * | 3/2007 | Kudo et al. | 345/690 |
| 2005/0052477 | A1 * | 3/2005 | Kudo et al. | 345/690 |
| 2005/0200591 | A1 * | 9/2005 | Satoh et al. | 345/103 |

FOREIGN PATENT DOCUMENTS

| | | |
|---|---|---|
| JP | 2002-229520 | 8/2002 |
| JP | 2005-049868 | 2/2005 |
| JP | 2005-099665 | 4/2005 |
| JP | 2005-156962 | 6/2005 |

OTHER PUBLICATIONS

Office Action in Japanese Patent Application No. 2005/281924, dated Jul. 20, 2010 (in Japanese) [2 pages].

* cited by examiner

*Primary Examiner* — Alexander Eisen
*Assistant Examiner* — Robin Mishler
(74) *Attorney, Agent, or Firm* — Antonelli, Terry, Stout & Kraus, LLP.

(57) ABSTRACT

In consideration of the current leakage path of a liquid crystal panel and a signal line voltage fluctuation due to the current leakage path, a γ adjusting function (second driving method) is applied for each divided period in the first driving method. In a signal line driving unit, a gray scale voltage obtained by adding or subtracting a voltage fluctuation value different in each of the output periods of each gray scale is generated, and a gray scale voltage taking the voltage fluctuation value into consideration is applied to a signal line.

11 Claims, 9 Drawing Sheets

FIG. 5A
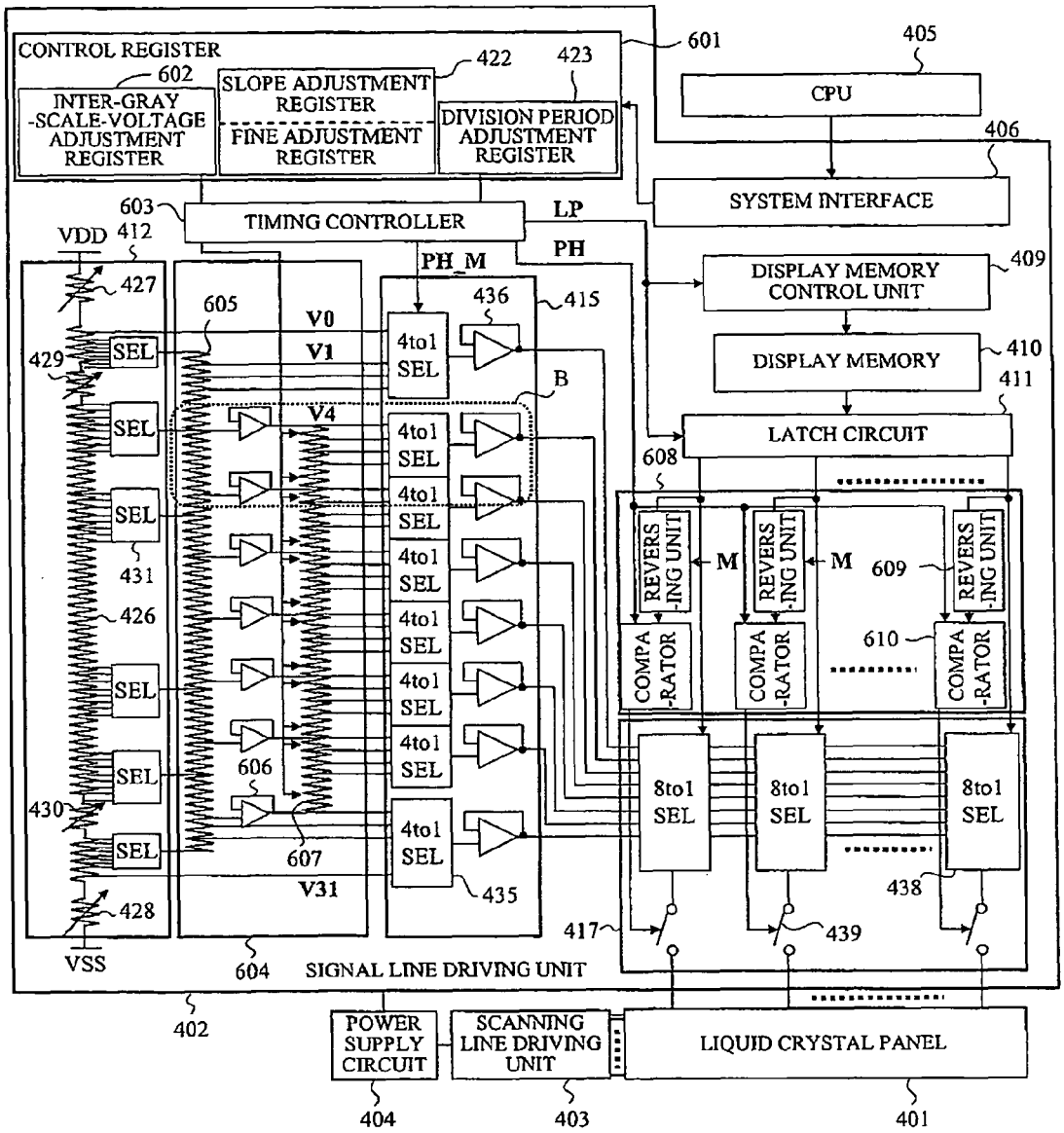
FIG. 5B
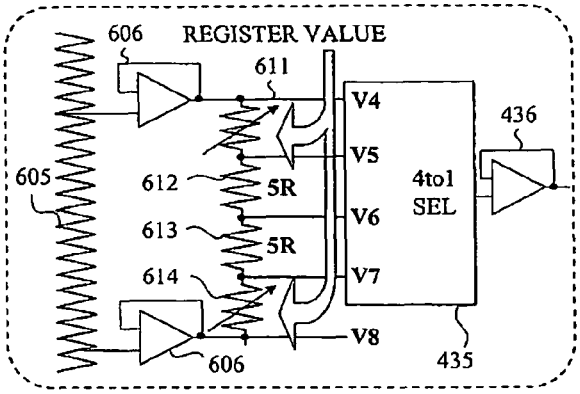
FIG. 5C
| Reg | 611 | Reg | 614 |
|---|---|---|---|
| 00 | 5R | 00 | 5R |
| 01 | 10R | 01 | 10R |
| 10 | 25R | 10 | 25R |
| 11 | 50R | 11 | 50R |

DISPLAY DRIVER

CLAIM OF PRIORITY

The present application claims priority from Japanese Patent Application No. JP 2005-261924 filed on Sep. 9, 2005, the content of which is hereby incorporated by reference into this application.

TECHNICAL FIELD OF THE INVENTION

The present invention relates to the technology for a display driver (such as IC mounted with a driving circuit) to be provided in a mobile device such as a cellular phone. More particularly, it relates to the technology for a driving method and a driving circuit of a display device operable with small power consumption and small-scale circuit.

BACKGROUND OF THE INVENTION

Conventionally, as a technology for a driving circuit for a display device such as TFT liquid crystal display, the technology for a driving circuit disclosed in U.S. Patent Publication No. 2005-052477 (JP-A No. 2005-99665) has been known. This driving circuit has gray scale voltage lines in accordance with the number of gray scales of high-order bits of display data, a selector which receives a pulse signal at each time determined in advance so as to correspond to low-order bits of the display data and selects a gray scale voltage line in accordance with the contents of the high-order bits to output the voltage to a signal line only during the period when the pulse signal is kept active, and a gray scale voltage generating unit for supplying a gray scale voltage, which is changed by the number of gray scales of low-order bits of image data, to each gray scale voltage line. In the driving method disclosed in U.S. Patent Publication No. 2005-052477, one gray scale voltage is selected from a gray scale voltage group whose voltage levels are changed every predetermined divided period in accordance with a high-order bit of display data, and the selected gray scale voltage is outputted to a signal line only during the period in accordance with the information of a low-order bit of the display data. This method is hereinafter referred to as a first driving method. According to the configuration and operation described above, it is possible to realize more gray scale displays in smaller circuit scale.

Moreover, as a conventional method for realizing the γ adjusting function, the driving circuit disclosed in JP-A No. 2005-49868 has been known. In the circuit and method thereof, amplitude adjustment, slope adjustment, and fine adjustment for an S-shaped γ-characteristic curve can be made by an amplitude adjustment register, slope adjustment register, and fine adjustment register so that each gray scale voltage corresponding to a desired γ-characteristic in the characteristics of each liquid crystal panel can be adjusted.

SUMMARY OF THE INVENTION

In the case of the above first driving method, when a gray scale display is performed on a liquid crystal panel having a certain structure and its display device, display luminance does not uniformly change and a streak-like image quality deterioration occurs in some cases. For example, when there is a current leakage path between a signal line and an opposite electrode in a liquid crystal panel, electric charges charged in the signal line and a selected pixel electrode move to the opposite electrode and the gray scale voltage level applied to the signal line and pixel electrode is fluctuated in come cases. Accordingly, image quality deterioration occurs and a desired display luminance cannot be obtained.

FIG. 1 shows an example of a liquid crystal panel 401 according to a known technology, to which a technology of the present invention is to be applied. The liquid crystal panel 401 has a TFT substrate 101, an opposite electrode 102, a liquid-crystal layer 103, signal lines (also referred to as data line) 104, scanning lines 105, and current leakage paths 106. It is known that image quality deterioration occurs in the liquid crystal panel 401 particularly having the current leakage path 106 between the signal line 104 and the opposite electrode 102.

In this case, a cause of the image quality deterioration will be described below with reference to FIG. 8A and FIG. 8B. FIG. 8A shows voltage transitions of the signal line (104) and opposite electrode (102) in one scanning period. A reference numeral 201 denotes one scanning period, 202 denotes a first divided period, 203 denotes a second divided period, 204 denotes a third divided period, and 205 denotes a fourth divided period. Moreover, a reference numeral 206 denotes an opposite electrode voltage, 207 denotes the ideal voltage of the gray scale in which a voltage application period is the first divided period 202, and 208 denotes the voltage transition of the signal line (104) when the first driving method is applied to the liquid crystal panel 401 shown in FIG. 1.

First, in the case of the first driving method, when focusing attention on the gray scale in which a voltage application period is the first divided period 202, after the first division period ends, the signal line 104 is turned to a floating state in the time of "one scanning period 201-first divided period 202" (rest of the one scanning period 201). Then, when the current leakage path 106 is present between the signal line 104 and the opposite electrode 102, the gray scale voltage of the signal line 104 fluctuates to the side of the opposite electrode 206 and the signal line voltage transition 208 actually occurs relative to the ideal voltage 207. On the other hand, when focusing attention on the gray scale in which a voltage application period is the fourth divided period 205, a TFT is turned to an off-state immediately after the fourth divided period 205 is completed. Therefore, the gray scale voltage of the signal line 104 is hardly fluctuated.

As described above, voltage fluctuation different in each divided period (202 to 205) occurs in the signal line 104. For example, when assuming display data as 32 levels and the number of divisions of one scanning period 201 as 4, the deviation of this voltage fluctuation value is repeated eight times for each four gray scales.

FIG. 8B shows the gray scale number-gray scale voltage characteristics based on the output voltage of the signal line driving unit connected to the signal line 104 and the voltage of the signal line (104) immediately after a TFT is turned to an off-state. A reference numeral 209 denotes the characteristics between a gray scale number of the output voltage of a signal-line driving unit and a gray scale voltage, and 210 denotes the characteristics between a gray scale number of a pixel electrode voltage (signal line voltage) immediately after a TFT is turned to an off-state and a gray scale voltage. The display luminance of the liquid crystal panel 401 is determined by a pixel electrode voltage (210). Therefore, when gray scale display is performed, image quality deterioration in which 8 streaks are observed occurs. Note that a mechanism in which image quality deterioration occurs has been described here based on the case where the voltage of the signal line 104 is changed from a low level to a high level as shown in FIG. 8A. However, in the case of the first driving method, image quality deterioration occurs similarly also when the voltage of the signal line 104 is changed from a high level to a low level.

An object of the present invention is to provide the technology capable of solving the problem of the image quality deterioration as described above and achieving the multi-gray scale display and reduction of image quality deterioration with a small-scale circuit.

The cause of the above-described image quality deterioration lies in the fact that the voltage fluctuation value of the signal line 104 changes in each of the divided periods (202-205). Therefore, in the technology of the present invention, a function and means for adjusting the γ-characteristic in each divided period (202 to 205) is used. The γ-characteristic corresponds to a relation of display data, gray scale voltage, and actual display luminance (pixel electrode voltage). As a conventional method for achieving the γ adjusting function, the driving circuit disclosed in JP-A No. 2005-49868 is known.

In such a circumstance, in order to achieve the object described above, the technology of the present invention has the configuration in which the γ adjusting function disclosed in JP-A No. 2005-49868 (hereinafter, referred to as second driving method) is applied to the first driving method. More specifically, in this configuration, for the voltage fluctuations in the signal line (104) and a pixel electrode generated when applying the first driving method to a display panel such as the liquid crystal panel (401) having the current leakage path (106) between the signal line (104) and the opposite electrode (102), means for applying and outputting a gray scale voltage, to which level adjustment such as addition or subtraction is applied in consideration of the voltage fluctuation value, that is, so as to cancel the influence of the voltage fluctuations, to the signal line (104) is provided.

FIG. 2A shows a transition of voltage levels of the signal line (104) in the driving method and the configuration of the driving circuit in which the second driving method is applied to the first driving method in the technology of the present invention. A gray scale voltage Vx ($Vx=Vdata+\Delta Vy$, x=0, 1, 2, . . . , 31) obtained by previously adding voltage fluctuation values $\Delta V1$, $\Delta V2$, and $\Delta V3$ different in each divided periods (202-205) is generated for the ideal voltage 207, and a signal-line driving unit applies the voltage (Vx) to the signal line 104 of the liquid crystal panel 401. As a result, it is possible to adjust a voltage difference between adjacent gray scales immediately after a TFT is turned to an off-state.

FIG. 2B shows gray scale number-gray scale voltage characteristics based on the voltage of the signal line (104). A reference numeral 301 denotes a characteristic between gray scale number of an output voltage of a signal line driving unit and the voltage, 302 denotes a characteristic between gray scale number of a pixel electrode voltage (signal line voltage) and the voltage at the timing when a TFT is turned to an off-state. As shown by the pixel electrode voltage (302) for actually determining a display luminance, the characteristic curve becomes smooth, and a streak-like image quality deterioration generated in the conventional technology can be avoided.

As described above, by using a driver of the present invention, it is possible to achieve the multi-gray scale display in a small-scale circuit and reduction of image quality deterioration which is the first object of the present invention at the same time.

The driver of the present invention has a gray scale voltage generating unit for generating gray scale voltages corresponding to each of a plurality of gray scales and a gray scale voltage selecting unit for selecting a gray scale voltage to be output to the signal line of a display panel in accordance with inputted display data. The gray scale voltage selecting unit selects a gray scale voltage to be outputted to each of the signal lines from gray scale voltages outputted from the gray scale voltage generating unit in a time division manner to control the length of a period for outputting a selected gray scale voltage in accordance with the display data. The gray scale voltage generating unit can generate the gray scale voltage whose level to an ideal voltage fluctuates in each of a plurality of periods obtained by time division of one scanning period for outputting the gray scale voltage to the signal line. Moreover, the driver of the present invention has means for generating the gray scale voltage whose level differs in each of the time-divided periods obtained by adding or subtracting a voltage fluctuation value in accordance with the voltage fluctuation value in each time-divided period on the signal line. Alternatively, the driver of the present invention has means for applying level adjustment such as addition or subtraction or performing conversion to the gray scale voltage generated by the gray scale voltage generating unit and then outputting the voltage. Particularly, the gray scale voltage generating unit outputs a gray scale voltage in which the level gradually (stepwise) fluctuates. Moreover, the driver of the present invention has a register for level adjustment for each of the time-divided periods.

The driver of the present invention has an output circuit (corresponding to 412 and 413 in the embodiment) for outputting a voltage which changes stepwise in the dime-divided periods in one horizontal period, selecting circuits (414 to 417) for determining the level of the voltage which changes stepwise based on the display data, and circuits (427 and 428) for shifting the level of the voltage which changes stepwise for each of the time-divided periods. Moreover, the driver of the present invention has an output circuit for outputting a voltage which changes stepwise in the dime-divided periods in one horizontal period, selecting circuits for determining the level of the voltage which changes stepwise based on the display data, and setting circuits (amplitude adjustment registers 418 to 421) for setting the level of the voltage which changes stepwise for each of the divided periods.

According to the present invention, it is possible to realize a driving circuit capable of achieving multi-gray scale display with a small scale circuit and reducing the image quality deterioration.

BRIEF DESCRIPTIONS OF THE DRAWINGS

FIG. 5A is a diagram showing a configuration of a system (liquid crystal display) including the driver (TFT liquid crystal driving circuit) of the second embodiment of the present invention, particularly a block diagram of a signal line driving unit;

FIG. 5B is an enlarge view showing the configuration of a part of the system;

FIG. 5C is a table showing a setting example of the register in FIG. 5B;

Figure 1:
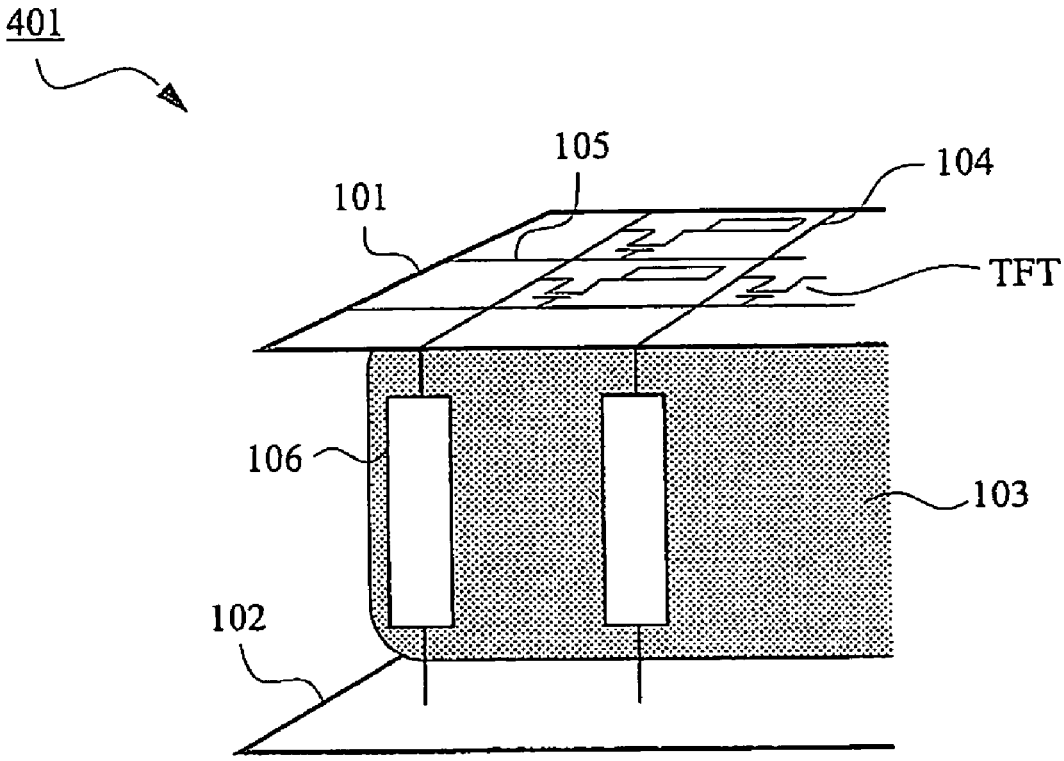
FIG. 1 is an explanatory diagram showing a configuration example of a liquid crystal panel which is a known technology to which a driver of an embodiment of the present invention is to be applied and a factor of the voltage level fluctuation (current leakage path) of the signal line of the liquid crystal panel.
Figure 6A:
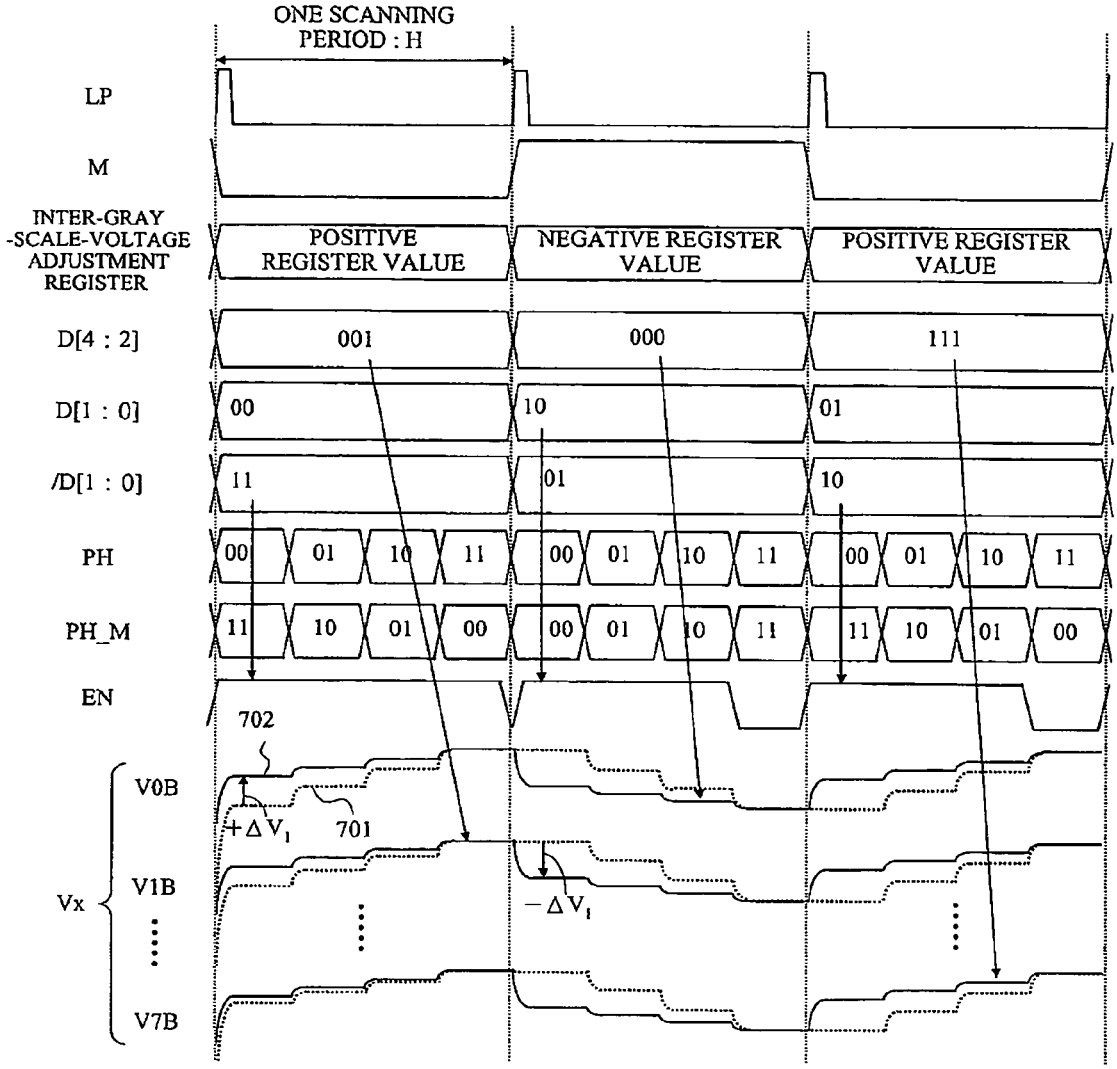
FIG. 6A is a timing chart of each signal in the driving method of the second embodiment of the present invention.
Figure 6B:
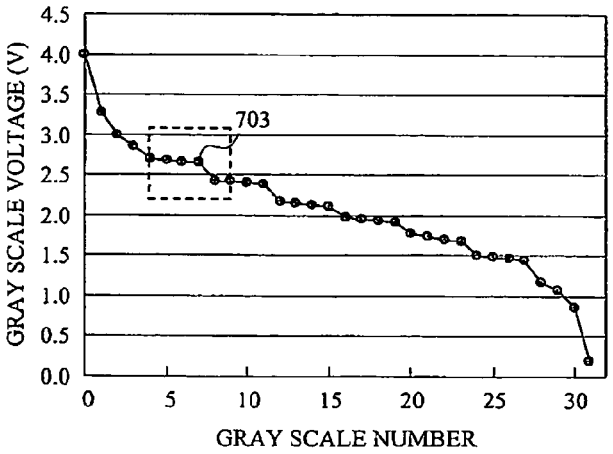
FIG. 6B is a diagram showing a gray scale number-gray scale voltage characteristic illustrating the effect of the driving method.
Figure 6C:
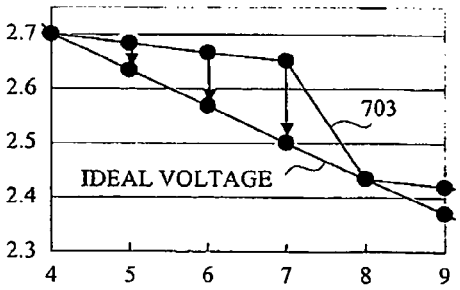
Figure 7A:
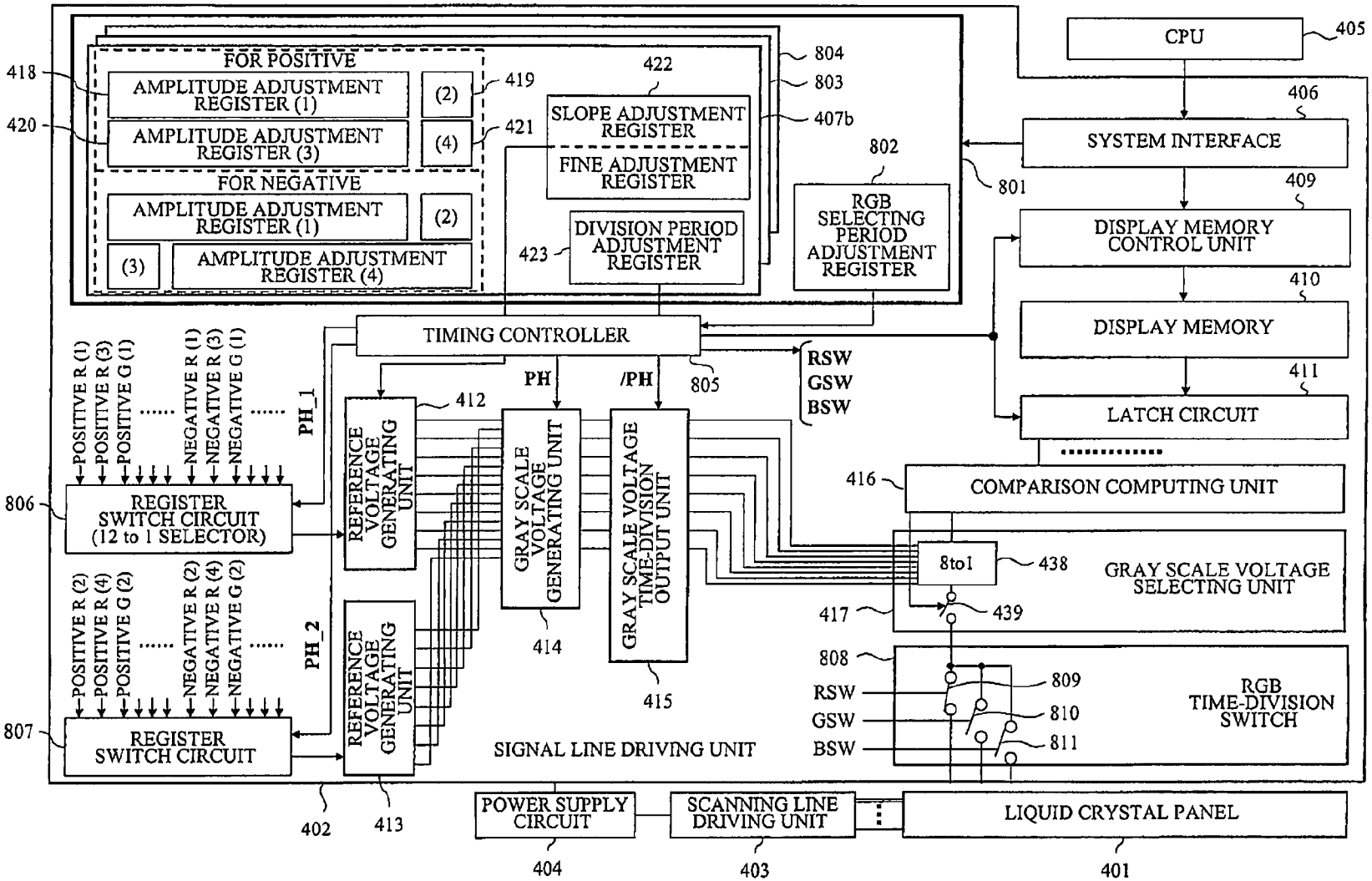
Figure 7B:
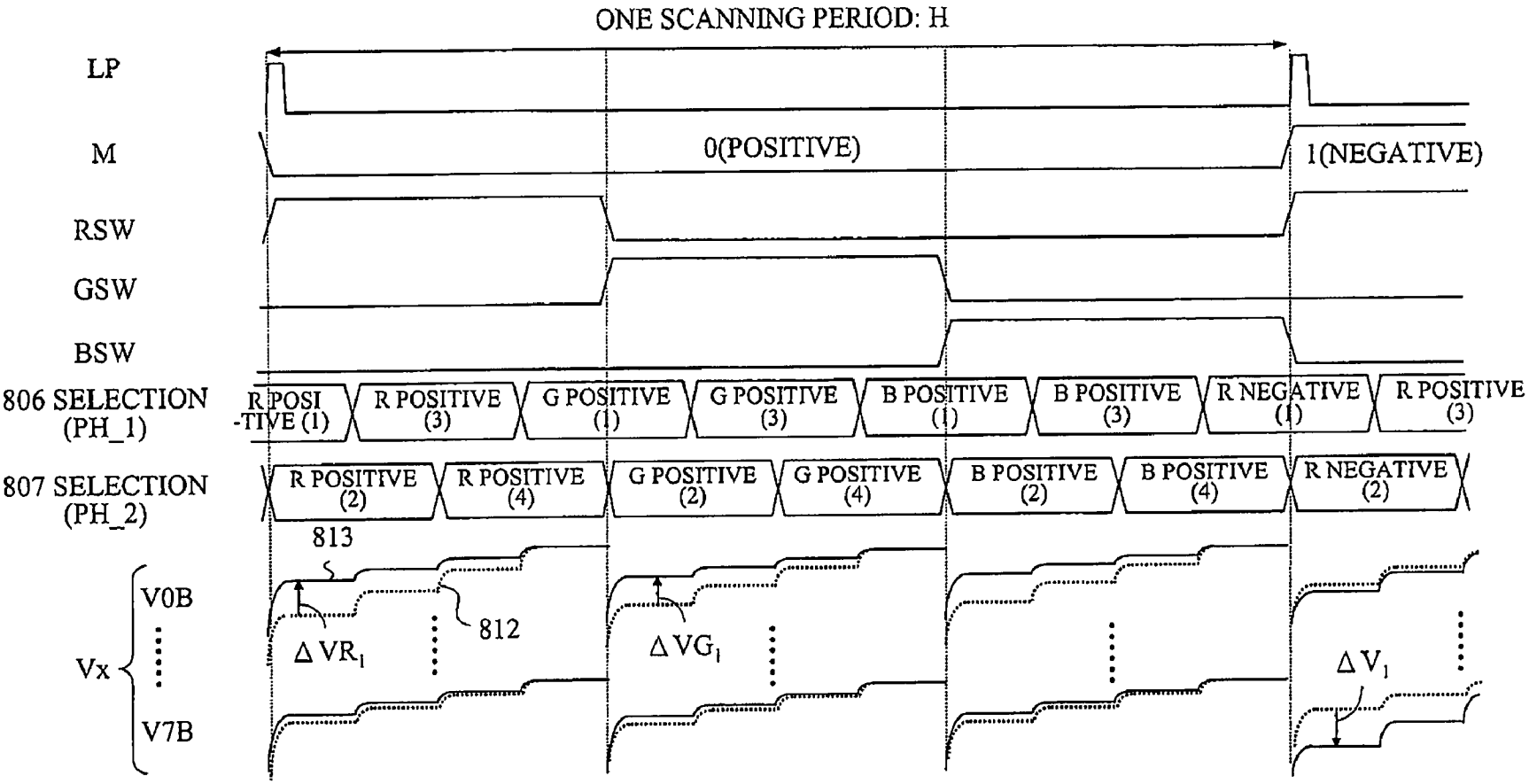
Figure 8A:
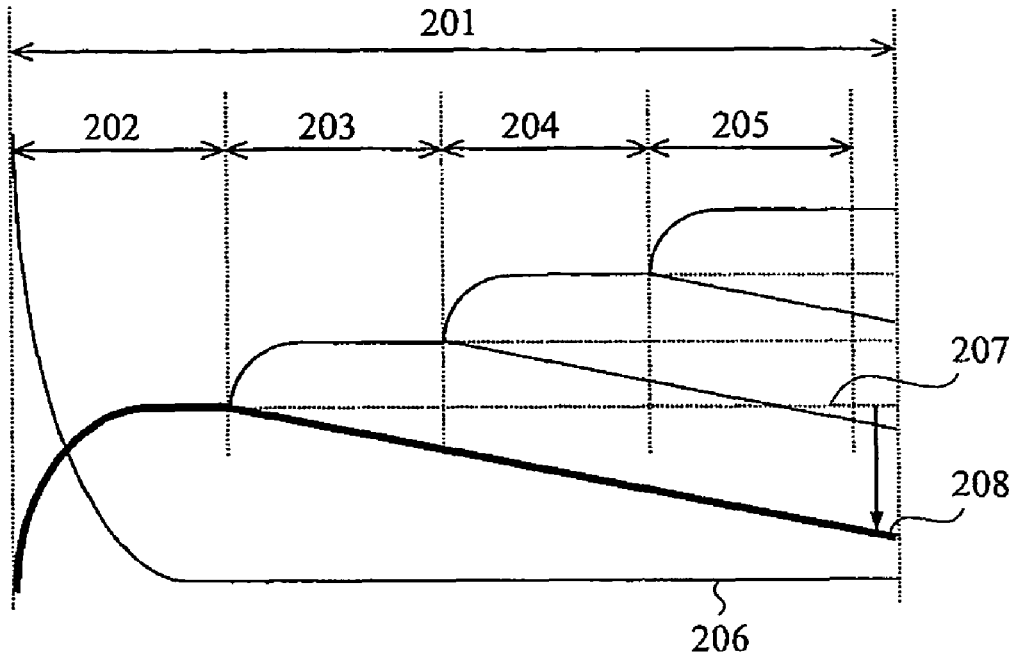
Figure 8B:
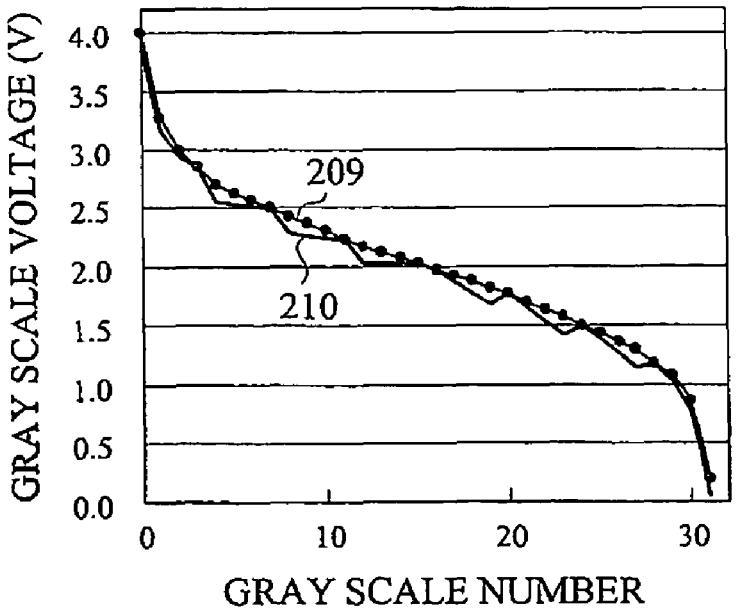

FIG. and FIG. 6C is an enlarged view of a part in FIG. 6B;

FIG. 7A is a diagram showing a configuration of a system (liquid crystal display) including the driver (TFT liquid crystal driving circuit) of the third embodiment of the present invention;

FIG. 7B is a timing chart of each signal in the driving method of the third embodiment;

FIG. 8A is a diagram showing a signal line voltage when the first driving method is applied to the liquid crystal panel shown in FIG. 1 and a voltage level is changed from a low voltage to a high voltage; and FIG. 8B is a diagram showing a gray scale number-gray scale voltage characteristic when a voltage level is changed from a low voltage to a high voltage.

DESCRIPTIONS OF THE PREFERRED EMBODIMENTS

Hereinafter, embodiments of the present invention will be described in detail with reference to the accompanying drawings. Note that components having the same function are denoted by the same reference symbols throughout the drawings for describing the embodiment, and the repetitive description thereof will be omitted. FIG. 1 to FIG. 7 are drawings for describing the embodiment. FIG. 8A and FIG. 8B are drawing for describing prior arts. Note that, when there are a plurality of components having the same function in each drawing, a symbol or numeral is provided only for some of them.

The driver of this embodiment is provided with a gray scale voltage adjusting function capable of adjusting a gray scale voltage output in consideration of the voltage fluctuation in a signal line of a display device. The function is used to drive a display device according to the driving method of this embodiment. The driving method of this embodiment is obtained by combining the second driving method with the first driving method.

Hereinafter, the prior art is briefly described for comparison with this embodiment. In the case where an active matrix display panel, for example, a TFT liquid crystal panel is driven in accordance with the first driving method as a prior art, when the selecting period of the signal line 104 ends, supply of electric charges from the driving circuit is stopped, electric charges of the signal line 104 are retained by the capacitance between wirings in the liquid crystal panel 401, for example, the capacitance coupling between the signal line 104 and the scanning line 105, and the signal line 104 is turned to a floating state. Moreover, the gray scale voltage of a pixel electrode in a selected state retains the same voltage as that of the signal line 104 until a TFT is turned to an off-state.

However, when the driving circuit to be driven by the first driving method is connected to the TFT liquid crystal panel 401 having the current leakage path 106 between the signal line 104 and the opposite electrode 102 as shown in FIG. 1, electric charges constantly charged to the signal line 104 continuously move to the opposite electrode 102. Therefore, a signal line voltage Vdata starts to fluctuate from the moment when the signal line 104 becomes a floating state. Consequently, a desired effective value cannot be obtained and streak-like image quality deterioration occurs when the gray scale display is performed.

Incidentally, as shown by the following expression 1, the above-described voltage fluctuation value ΔVy (y=1, 2, 3, or 4) is determined depending on the potential difference between the signal line voltage Vdata and the opposite electrode voltage Vcom, capacitive load CLCD in the liquid crystal panel 401, impedance Rleak of the current leakage path 106, and a period of the floating state of the signal line 104 (one scanning period 201-signal line selecting period).

$$\Delta Vy=-(V\text{data}-V\text{com})\times e\hat{}\{-(4-y)\times t\div\tau\} \qquad \text{Expression 1}$$

First, when focusing attention on the liquid crystal panel 401, the voltage fluctuation value ΔVy increases as the capacitive load CLCD in the panel decreases. Moreover, the voltage fluctuation value ΔVy increases as the impedance Rleak of the current leakage path 106 decreases. Therefore, it is found that the degree of image quality deterioration differs in each liquid crystal panel 401 to be driven.

Then, when focusing attention on the period in which the signal line 104 becomes a floating state, based on time t (t=H/4) obtained by dividing one scanning period H into four equal periods, the floating period of the first gray scale group in which the signal line 104 is selected only in the first period is 3t, the floating period of the second gray scale group in which the signal line 104 is selected up to the third period is 2t, the floating period of the third gray scale group in which the signal line 104 is selected up to the third period is t, and the floating period of the fourth gray scale group in which the signal line 104 is selected up to the fourth period is 0. Then, the voltage fluctuation value ΔV1 of the first gray scale group is largest, ΔV2 and ΔV3 gradually decrease in order, and the voltage fluctuation value ΔV4 of the fourth gray scale group is 0.

In the case of this embodiment, in consideration of the fact that the portion of e^{−(4−y)×t÷τ} in expression 1 becomes constant when the y-th gray scale group is the same in the same liquid crystal panel 401, the gray scale voltage Vx (Vx=Vdata+ΔVy) to which the voltage fluctuation value ΔVy is added is generated for each gray scale group and applied to the signal line 104.

Hereinafter, a driving method and a driver of this embodiment and a system including the driver will be described.

First Embodiment

Figure 3:
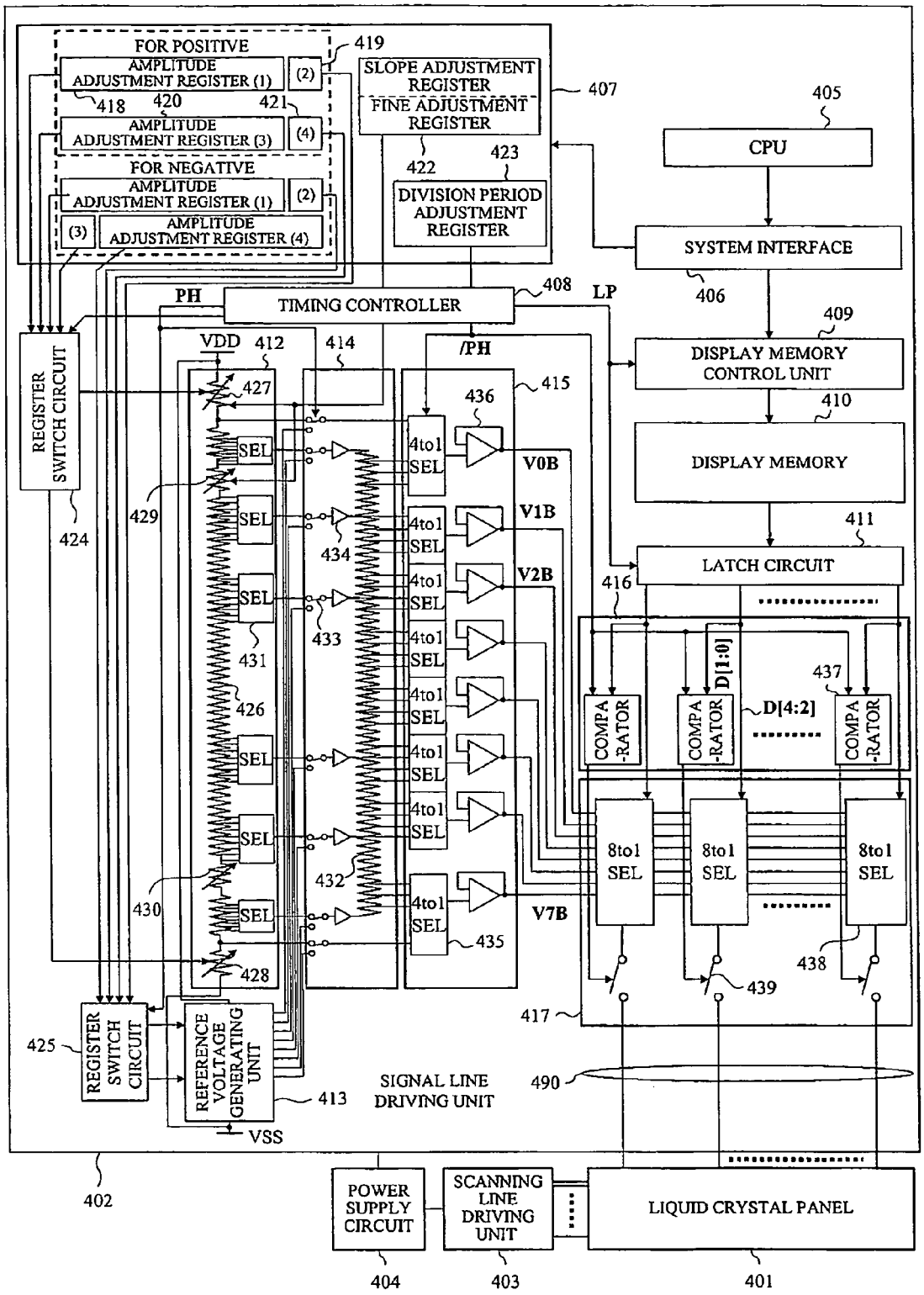
FIG. 3 is a diagram showing a configuration of a system (liquid crystal display) including the driver (TFT liquid crystal driving circuit) of the first embodiment of the present invention, particularly a block diagram of a signal line driving unit.
Figure 4A:
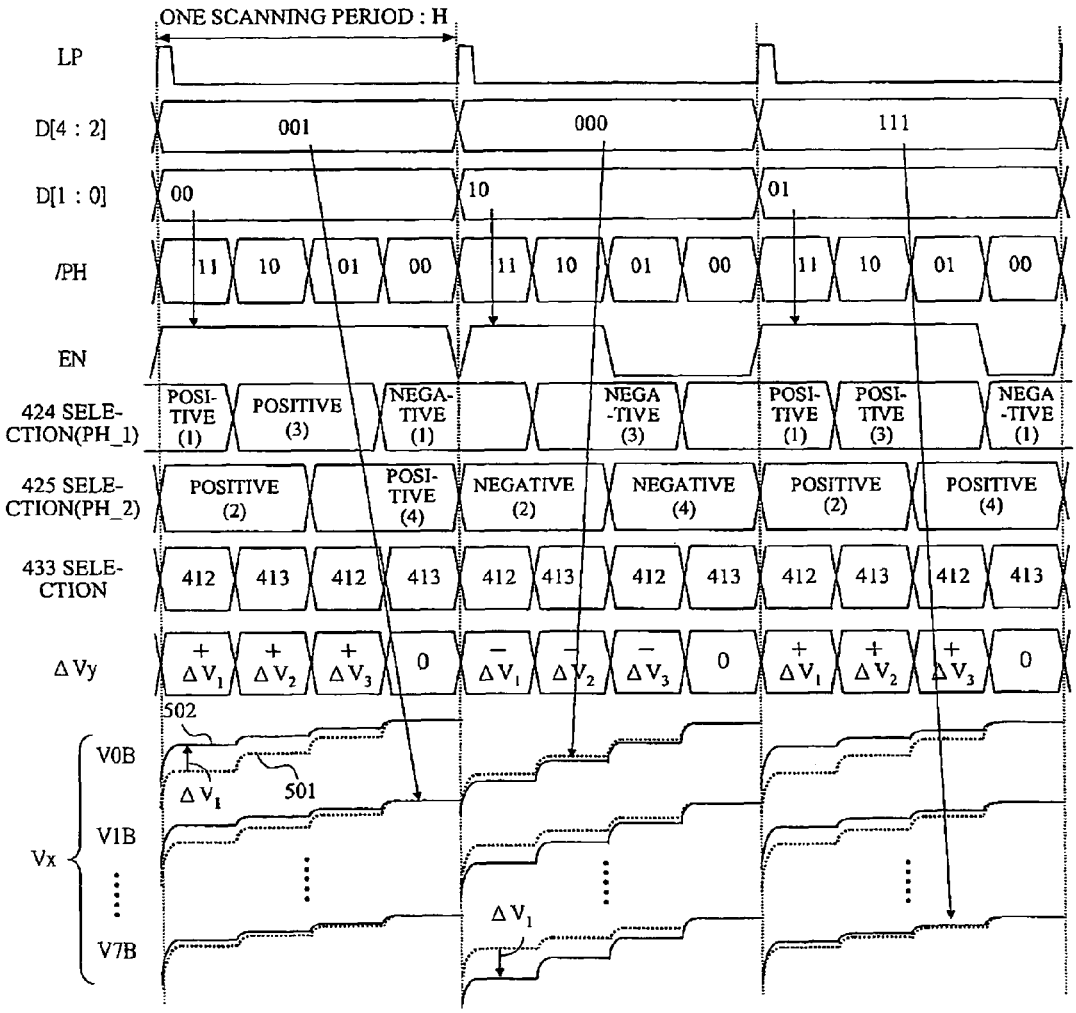
FIG. 4A is a timing chart of each signal in the driving method of the first embodiment of the present invention.
Figure 4B:
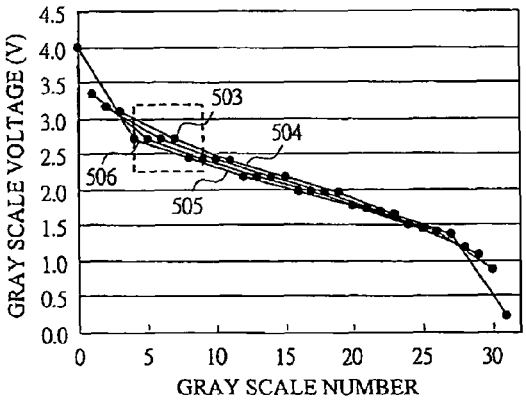
FIG. 4B is a diagram showing a gray scale number-gray scale voltage characteristic illustrating the effect of the driving method.
Figure 4C:
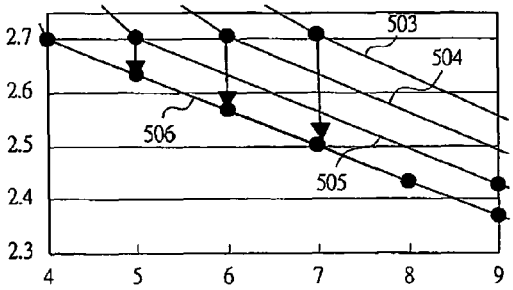
FIG. 4C is an enlarged view of a part of FIG. 4B.

A configuration and operations of the first embodiment will be described below with reference to FIG. 3 and FIG. 4. FIG. 3 shows a configuration of a system (liquid crystal display) including the driver of the first embodiment. FIG. 4A is a timing chart of each signal showing the control of a register and a switch in the driving method of the first embodiment. FIG. 4B and FIG. 4C show the gray scale number-gray scale voltage characteristics in the driving method.

First, as shown in FIG. 3, the liquid crystal display has a configuration including a signal line driving unit 402, a scanning line driving portion 403, a power supply circuit 404, and a CPU 405 for the liquid crystal panel 401. The signal line driving unit 402 is a driving circuit for driving the liquid crystal panel 401 in accordance with the driving method of this embodiment.

The liquid crystal panel 401 has a structure in which liquid crystal is sealed between two glass substrates. As shown in FIG. 1, TFTs are disposed for each pixel on one glass substrate and the opposite electrodes 102 are disposed on the other glass substrate. Moreover, the liquid crystal panel 401 is a TFT liquid crystal panel referred to as the active matrix type in which the scanning line s105 and the signal lines 104 to be connected to TFTs are arranged in matrix, the drain terminal of the TFT is connected to the output of the gray scale voltage selecting unit 417 via the signal line 104, the gate terminal of the TFT is connected to the output of the scanning line driving unit 403 via the scanning line 105, and the source terminal of the TFT is connected to a pixel electrode. Furthermore, this embodiment is particularly directed to the liquid crystal panel 401 having the current leakage path 106 between the signal line 104 and the opposite electrode 102.

Note that, although the description is progressed based on the liquid crystal panel 401, the present invention can be applied to another device capable of controlling a display luminance at a voltage level and having a signal line corresponding to the above-described current leakage path 106, for example, an organic EL device.

A signal line 490 connected to the gray scale voltage selecting unit 417 is an extended portion of the signal line 104 in the liquid crystal panel 401 in FIG. 1. Signal line voltage fluctuation occurs in the signal line 490 extending to the panel side from the gray scale voltage selecting unit 417 and the signal line 104 in the panel.

The signal line driving unit 402 is a block which controls the display luminance of the liquid crystal panel 401 by converting digital display data into analog gray scale voltage Vdata and applying the gray scale voltage Vdata to a pixel electrode via the signal line 104 of the liquid crystal panel 401.

The scanning line driving unit 403 is a block for line-sequentially applying a selection signal synchronizing with a line clock LP generated by the timing controller 408 in the signal line driving unit 402 described later to the scanning line 105 of the liquid crystal panel 401.

The power supply circuit 404 is a block for generating a power supply voltage level necessary in the signal line driving unit 402 and the scanning line driving unit 403 from a power supply voltage Vci supplied from outside. Note that the generation of the power supply voltage level is achieved by multiplying a power supply voltage Vci by a charge pump circuit or the like by n.

Next, blocks constituting the signal line driving unit 402 will be described below. The signal line driving unit 402 has a system interface 406, a display memory control unit 409, a display memory 410, a latch circuit 411, a control register 407, a timing controller 408, a first reference voltage generating unit 412, a second reference voltage generating unit 413, a gray scale voltage generating unit 414, a gray scale voltage time-division output unit 415, a comparison computing unit 416, a gray scale voltage selecting unit 417, and register switching circuits 424 and 425.

The control register 407 includes amplitude adjustment registers (418 to 421), slope adjustment register and fine adjustment register 422, and a divided period adjustment register (divided period PH setting register) 423. The amplitude adjustment register has amplitude adjustment registers (for positive electrode and negative electrode) such as an amplitude adjustment register for first gray scale group (first period amplitude adjustment register) 418, an amplitude adjustment register for second gray scale group (second period amplitude adjustment register) 419, an amplitude adjustment register for third gray scale group (third period amplitude adjustment register) 420, and an amplitude adjustment register for fourth gray scale group (fourth period amplitude adjustment register) 421. The slope adjustment register and fine adjustment register 422 are the same as those described in JP-A No. 2005-49868.

The first reference voltage generating unit 412 has a resistor 426, variable resistors 427, 428, 429, and 430, and selector circuits 431. Reference numerals 427 and 428 denote amplitude adjusting variable resistors, and 429 and 430 denote slope adjusting variable resistors. The gray scale voltage generating unit 414 has a ladder resistor 432, 2-to-1 switches 433, and operational amplifiers 434. The gray scale voltage time-division output unit 415 has 4-to-1 selectors 435 and operational amplifier circuits 436. The comparison computing unit 416 has comparators 437. The gray scale voltage selecting unit 417 has 8-to-1 selectors 438 and switch circuits 439 and is connected to the signal line 490.

The first driving method is realized by the gray scale voltage time-division output unit 415, the comparison computing unit 416, and the gray scale voltage selecting unit 417. However, the slope adjustment register and the fine adjustment register 422 can be omitted.

Operations of the internal blocks of the signal line driving unit 402 are described below.

The system interface 406 receives display data and instructions from the CPU 405 and transfers them to the control register 407. In this case, the instructions correspond to the information for determining an internal operation of a driving circuit, which include a frame frequency, the number of driving lines, divided period information at the time of gray scale time-division driving, a set value of a register of various adjusting functions regarding the γ-characteristic.

In the control register 407, a register for the γ adjusting function (second method) is set for each polarity of voltage applied for driving the liquid crystal panel 401. That is, amplitude adjustment registers for positive electrode (418 to 421) and similar amplitude adjustment registers for negative electrodes are provided. Basically, the control register 407 is a block for storing instruction data and transferring the data to each block. For example, instructions regarding the frame frequency, the number of driving lines, and divided period information are transferred to a timing controller 408 described later. Moreover, instructions to be stored in the amplitude adjustment registers (418 to 421) are transferred to register switching circuits 424 and 425 described later, and instructions to be stored in the slope adjustment register and fine adjustment register 422 are transferred to the reference voltage generating units (412 and 413) described later. Note that the display data is once stored in the control register 407 and is outputted to the display memory control unit 409 described later together with an instruction for designating a display position.

The timing controller 408 has a dot counter and generates a line clock LP based on a dot clock inputted from outside. Moreover, the timing controller 408 generates a PH signal for specifying the divided period of each gray scale group for one scanning period from the divided period information transferred from the divided period adjustment register 423. The gray scale groups in this case are a first gray scale group including gray scale numbers of 4n, a second gray scale group including gray scale numbers of 4n+1, a third gray scale group including gray scale numbers of 4n+2, and a fourth gray scale group including gray scale numbers of 4n+3 in 32 gray scale numbers from 0 to 31.

The PH signal is a two-bit signal which is changed in the order of 00, 01, 10, and 11 in one scanning period and used for the register switching circuits 424 and 425 described later. Note that the timing controller 408 outputs /PH which is a reverse signal of the PH signal and /PH is used by the 4-to-1 selector 435 in the gray scale voltage time-division output unit 415. Moreover, the timing controller 408 has a two-bit counter which counts in each state change in PH[0] (PH signal low-order one bit)=PH[1](PH signal high-order one bit)⇔PH[0]≠PH[1] and a two-bit counter which counts in each state change in PH[1]=0⇔PH[1]=1, and the former outputs a PH_1 signal and the latter outputs a PH_2 signal.

The display memory control unit 409 is a block for performing the read and write operations of the display memory 410. At the time of the write operation, the control unit 409 outputs a signal for selecting the address of the display memory 410 based on an instruction for display position transferred from the control register 407, and simultaneously transfers the display data to the display memory 410. Moreover, at the time of the read operation, the control unit 409 collectively selects the display data for one line based on an instruction for display position transferred from the control register 407.

The display memory 410 has storage areas corresponding to the number of pixels of the liquid crystal panel 401, and its operations are controlled by the display memory control unit 409. Note that the display data read and designated by the display memory control unit 409 is transferred to the latch circuit 411.

The first and second reference voltage generating units (412 and 413) have the same circuit configuration and are constituted of a ladder resistor composed of a fixed resistor group (resistor 426), variable resistors 427 and 428 for performing amplitude adjustment, and variable resistors 429 and 430 for performing slope adjustment between the reference voltage VDD and the reference voltage VSS set in the power supply circuit 404 and selector circuits 431 for performing the fine adjustment. In this case, resistance values of the variable resistors 427 and 428 can be adjusted in accordance with register values transferred from the register switch circuits 424 and 425.

In FIG. 3, amplitude adjustment is performed by disposing the variable resistors 427 and 428 near reference voltages VDD and VSS and adjusting the resistance values thereof. Alternatively, it is also possible to use the configuration in which the variable resistors 427, 428, 429, and 430 are replaced with fixed resistors and the amplitude adjustment is performed by using the selector circuit based on a plurality of voltage levels divided by the resistors.

The gray scale voltage generating unit 414 is composed of the 2-to-1 switches 433 for selecting the reference voltages inputted from the first and second reference voltage generating units (412 and 413), operational amplifier circuits 434 for impedance-converting an output thereof, and a ladder resistor 432 for generating 32 gray scale voltage levels based on the output voltage of the operational amplifier circuits 434 when display data is a 5-bit data. Note that the 2-to-1 switch 433 can be switched by low-order one bit PH[0] of a PH signal generated by the timing controller 408. For example, when PH[0] is "0", an output voltage of the first reference voltage generating unit 412 is selected, and when PH[0] is "1", an output voltage of the second reference voltage generating unit 413 is selected.

The gray scale voltage time-division output unit 415 is constituted of the 4-to-1 selectors 435 for sequentially selecting adjacent gray scale voltages of four levels from the output of the gray scale voltage generating unit 414, that is, 32 voltage levels when display data is 5 bits and operational amplifier circuits 436 for impedance-converting the output of the 4-to-1 selectors 435. The switching of the 4-to-1 selector 435 is operated by a /PH signal generated in the timing controller 408, and gray scale voltages V0B to V7B whose voltage levels are changed four times from low-voltage side to high voltage side in one scanning period are outputted. Alternatively, the switching of the 4-to-1 selector 435 is operated by a PH signal, and gray scale voltages V0B to V7B whose voltage levels are changed four times from low voltage side to high voltage side in one scanning period are outputted.

The comparison computing unit 416 compares D[1:0] which is low-order two bit of display data D[4:0] and /PH signal by the comparator 437 to output an EN signal which becomes "1" (high) under the condition of /PH≧D[1:0] and "0" (low) under the condition of /PH<D[1:0].

When the switching of the 4-to-1 selector 435 is performed by a PH signal, D[1:0] is compared with the PH signal by the comparator 437 to output an EN signal which becomes "1" (high) under the condition of PH≧D[1:0] and "0" under the condition of PH>D[1:0].

The gray scale voltage selecting unit 417 is constituted of 8-to-1 selectors 438 as many as the number of signal lines 104 of the liquid crystal panel 401 and the switch circuit 439. In this case, when an EN signal transferred from the comparison computing unit 416 is "1" (high), the switch circuit 439 is turned on and the 8-to-1 selector 438 selects and outputs one of the gray scale voltages V0B to V7B in accordance with the value of D[4:2] which is high-order three bit of the display data. For example, when D[4:2] is 000, V0B is selected and outputted, and when D[4:2] is 111, V7B is selected and outputted. Meanwhile, when the EN signal is 0, the switch circuit 439 is turned off regardless of the value of D[4:2] and an output becomes high-impedance. Note that an output of the gray scale voltage selecting unit 417 is connected to the signal line 104 of the display panel 401 via the signal line 490.

The first register switch circuit 424 sequentially switches register values transferred from the amplitude adjustment registers 418 and 420 in accordance with a PH_1 signal transferred from the timing controller 408. Then, the register switch circuit 424 transfers its value to the variable resistors 427 and 428 in the first reference voltage generating unit 412. Similarly, the second register switch circuit 425 sequentially switches register values transferred from the amplitude adjustment resistors 419 and 421 in accordance with a PH_2 signal transferred from the timing controller 408. Then, the register switch circuit 425 transfers its value to a variable resistor in the second reference voltage generating unit 413. In this case, it is assumed that register values of the amplitude adjustment registers 418 and 420 of an odd-number gray scale group are transferred to the first register switch circuit 424 regardless of the polarity of an applied voltage and register values of the amplitude adjustment registers 419 and 421 of an even-number gray scale group are transferred to the second register switch circuit 425 regardless of the polarity of the applied voltage.

Next, control of registers and switches according to this first embodiment will be described with reference to FIG. 4A. In FIG. 4A, a reference numeral 501 denotes a gray scale voltage (output voltage) to be originally applied to the signal line 104 (pixel electrode) and 502 denotes an output voltage of the gray scale voltage time-division output unit 415 in this first embodiment.

First, display data is collectively transferred to the comparison computing unit 416, the gray scale voltage selecting unit 417, and the 2-to-1 switch 433 from the latch circuit 411 at the rise timing of a line clock LP generated by the timing controller 408. At the same time, a /PH signal generated by the timing controller 408 is transferred to the comparison computing unit 416 and the 4-to-1 elector 435, and PH_1 and PH_2 signals are transferred to the register switch circuits 424 and 425.

Note that the EN signal is generated by the comparison computing unit 416 as described above. Specifically, D[1:0] which is low-order two bit of the display data transferred from the latch circuit 411 is compared with a /PH signal to generate the EN signal.

The first register switch circuit 424 sequentially selects register values transferred from the positive amplitude adjustment registers 418 and 420 and negative amplitude adjustment register at the switch timing of a PH_1 signal transferred from the timing controller 408 and transfers them to the variable resistors 427 and 428. As a result, resistance values of the variable resistors 427 and 428 are changed four times in the time corresponding to two scanning periods in accordance with the set values. Moreover, the second register switch circuit 425 sequentially selects register values transferred from the positive amplitude adjustment registers 419 and 421 and the negative amplitude adjustment register at the switch timing of a PH_2 signal transferred from the timing controller 408 and transfers them to the variable resistors in the second reference voltage generating unit 413. As a result, the resistance values of the variable resistors are changed four times in the time corresponding to the two scanning periods in accordance with the set values.

Then, the 2-to-1 switch 433 selects an output voltage of the first reference voltage generating unit 412 or an output voltage of the second reference voltage generating unit 413 by the switch of the low-order one bit PH[0] of a PH signal. FIG. 4A shows the case where an output voltage of the first reference voltage generating unit 412 is selected at PH[0]=0 and an output voltage of the second reference voltage generating unit 413 is selected at PH[0]=1. Therefore, the γ-characteristic is changed in the order of amplitude setting of positive first gray scale group, amplitude setting of positive second gray scale group, amplitude setting of positive third gray scale group, amplitude setting of positive fourth gray scale group, amplitude setting of negative first gray scale group, amplitude setting of negative second gray scale group, amplitude setting of negative third gray scale group, and amplitude setting of negative fourth gray scale group. Note that, when the 2-to-1 switch 433 selects the first reference voltage generating unit 412 and selects, for example, an output voltage of the positive first gray scale group, the unselected second reference voltage generating unit 413 generates an output voltage of the positive second gray scale group. Consequently, the outputs of the first and second reference voltage generating units (412 and 413) can determine the voltage before the selection by the 2-to-1 switch 433, and a problem such as delay does not occur in the convergence at the time of the switching of the amplitude setting.

The 4-to-1 selector 435 sequentially selects one level of gray scale voltage from the four levels of adjacent gray scale voltages in accordance with a /PH signal and an operational amplifier circuit 436 serving as a voltage follower transfers the voltage to the gray scale voltage selecting unit 417. The voltages V0B to V7B which are the outputs of the eight operational amplifiers 436 are changed stepwise from low voltage side to high voltage side as shown in FIG. 4A. Also, the feature of this embodiment lies in that each of V0B to V7B is the output voltage 502 obtained by adding a voltage fluctuation value ΔVy to the gray scale voltage (output voltage) 501 to be originally applied to the signal line 104 (pixel electrode) when an applied voltage polarity is positive and that obtained by subtracting a voltage fluctuation value ΔVy from the gray scale voltage 501 when the applied voltage polarity is negative.

Figure 2A:
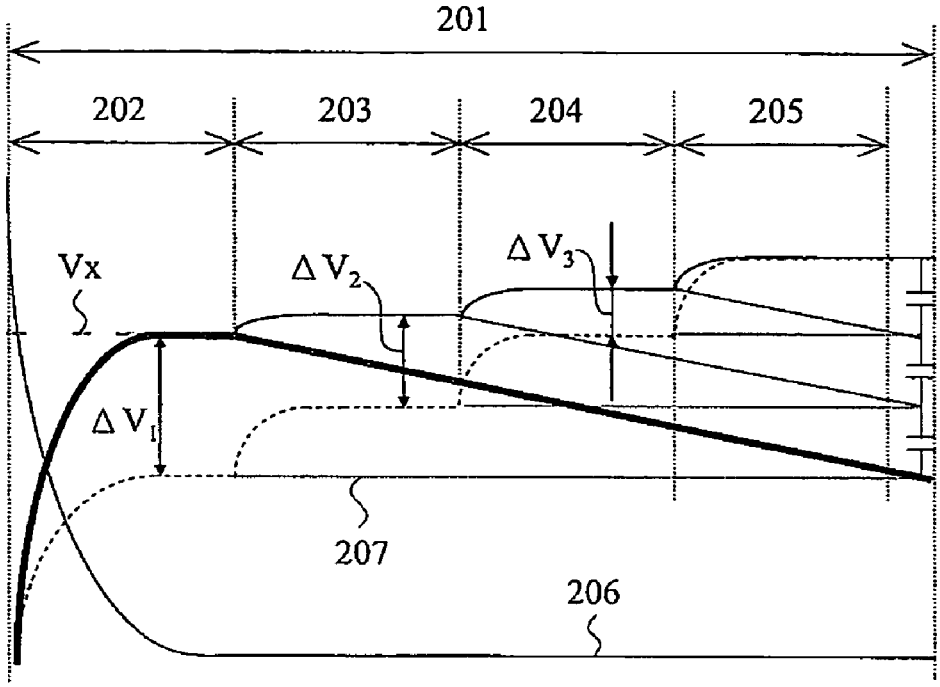
FIG. 2A is a diagram showing a change of signal line voltage level illustrating the effect obtained by the gray scale voltage adjusting function of the driving method and the driver according to an embodiment in which a second driving method is applied to a first driving method.
Figure 2B:
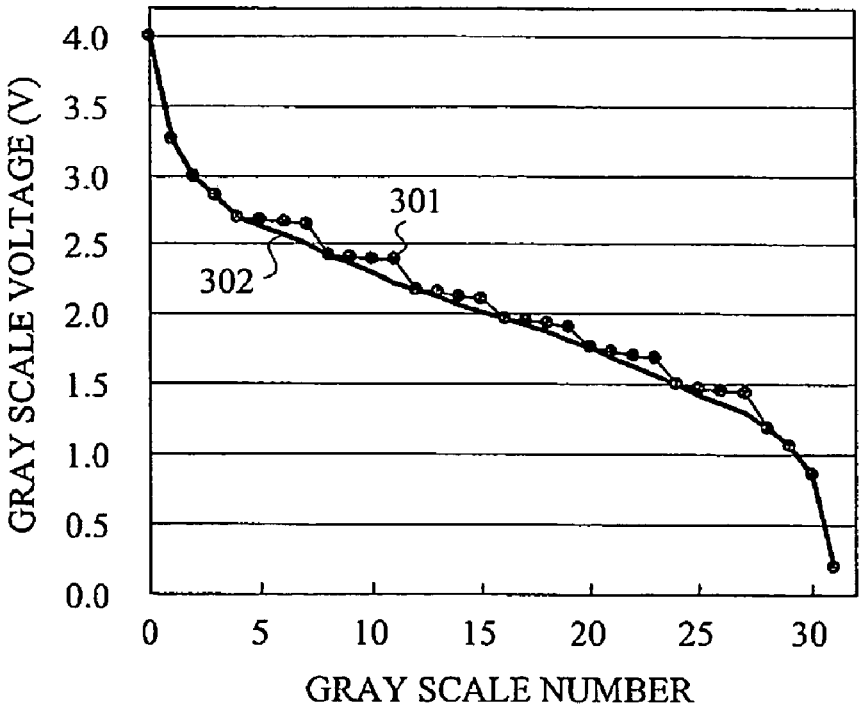
FIG. 2B is a diagram showing a gray scale number-gray scale voltage characteristic.

FIG. 4B shows characteristics of gray scale numbers and gray scale voltages of output voltages outputted in one scanning period in the gray scale voltage time-division output unit 415. A reference numeral 503 denotes a gray scale number-gray scale voltage characteristic of the first gray scale group. Similarly, a reference numeral 504 denotes the characteristic of second gray scale group, 505 denotes the characteristic of third gray scale group, and 506 denotes the characteristic of fourth gray scale group. The voltage levels other than that of the gray scale number-gray scale voltage characteristic 506 are obtained by adding or subtracting the voltage fluctuation value ΔVy and a characteristic similar to the gray scale number-gray scale voltage characteristic in FIG. 2B is obtained. FIG. 4C is an enlarged view of the portion of gray scale numbers 4 to 9 in FIG. 4B. When a voltage drop corresponding to each high-impedance period occurs, it can be expected that the gray scale number-gray scale voltage characteristics 503 to 505 become the same characteristic as the gray scale number-gray scale voltage characteristic 506 of the fourth gray scale group in which voltage drop does not occur. Consequently, it is possible to avoid the steak-like image quality deterioration which occurs in the prior art.

According to the circuit configuration and operation timing described above, even when the current leakage path 106 is present in the liquid crystal panel 401 of a liquid crystal display having the driver of this first embodiment, the first driving method can be applied. Therefore, it is possible to achieve the multi-gray scale display with small steady current and small-scale circuit and reduce the image quality deterioration due to the driving method.

Note that, in the first embodiment, the output voltage Vx to the signal line 104 is changed stepwise from low gray scale side to high gray scale side. However, the output voltage can also be changed stepwise from high gray scale side to low gray scale side as long as the change direction of the gray scale voltage is fixed in one scanning period. Moreover, though two register switch circuits and two reference voltage generating units are disposed, it is allowed to dispose one register switch circuit and one reference voltage generating unit. In this case, resistance values of the variable resistors 427 and 428 are changed eight times in two scanning periods by sequentially switching register values of positive amplitude adjustment registers (418 to 421) and the register value of the negative amplitude adjustment register for each divided period. Moreover, though input display data is described as five bits, it is allowed that the display data is 6 bits. Also, although the case where the gray scale voltage selecting unit 417 selects a voltage from adjacent gray scale voltages of four levels changed stepwise in one scanning period has been described, a configuration of selecting a voltage from gray scale voltages of two levels is also available. Moreover, though a driver including the display memory (410) and a liquid crystal display have been described, the present embodiment can be applied to a driver not including a display memory. Furthermore, in the case of this embodiment, a method for generating a γ-characteristic curve for each gray scale group has been described with using a case of applying the amplitude adjusting function disclosed in JP-A No. 2005-49868 as an example. However, it is also possible to apply the present invention to other adjusting functions.

Second Embodiment

A configuration and operations of the second embodiment will be described below with reference to FIG. 5 and FIG. 6.

Though the γ-characteristic is switched in each divided period in one scanning period H in the above-described first embodiment, the gray scale voltage generating unit does not switch the γ-characteristic in one scanning period and the voltage level of a gray scale voltage is adjusted in accordance with the above-described fluctuation value ΔVy in the second embodiment.

FIG. 5A shows a system (liquid crystal display) including the driver of the second embodiment. FIG. 5B shows a configuration of the circuit portion (B) in FIG. 5A. FIG. 5C shows a register setting example in FIG. 5B. FIG. 6A is the timing chart of each signal showing the control of a register and a switch in the driving method of the second embodiment. FIG. 6B and FIG. 6C show gray scale number-gray scale voltage characteristics in this driving method.

In FIG. 5A, configurations and operations of blocks other than a control register 601, a timing controller 603, a reference voltage generating unit 412, a gray scale voltage generating unit 604, and a comparison computing unit 608 are the same as those of the first embodiment. The gray scale voltage generating unit 604 has a ladder resistor 605, operational amplifier circuits 606, and an output ladder resistor 607.

The control register 601 includes an inter-gray-scale-voltage adjustment register 602, a slope adjustment register and fine adjustment register 422, and a divided period adjustment register 423. A register for the γ adjusting function is disposed for each polarity of the applied voltage for driving the liquid crystal panel 401. However, the slope adjustment register and fine adjustment register 422 are not always necessary. Also, the amplitude adjustment register can be provided though the register is omitted in FIG. 5A.

The timing controller 603 has a dot counter and generates a line clock LP based on the dot clock inputted from outside. Moreover, similar to the first embodiment, the controller 603 generates a PH signal for specifying the divided period of each gray scale group based on the divided period information transferred from the division period adjustment register 423, and the PH signal is used by a comparator 610 in a comparison computing unit 608 described later. Meanwhile, the timing controller 603 generates a signal obtained by reversing all bits of a PH signal when M="0" and a PH_M signal which becomes a PH signal when M="1" based on an M signal showing the polarity of a voltage applied to liquid crystal. Note that the PH_M signal is used in the 4-to-1 selector 435.

In the above-described first embodiment, the reference voltage generating unit 412 changes resistance values of the variable resistors 427 and 428 for each gray scale group to generate four types of γ-characteristic curves shifted by the voltage fluctuation value ΔVy, and the image quality deterioration is reduced by switching the characteristics in each division periods. Meanwhile, this second embodiment does not change the resistance values of the variable resistors 427 and 428 in one scanning period as described above.

The gray scale voltage generating unit 604 is constituted of a ladder resistor 605 for generating gray scale voltages of 32 levels through resistance division based on a reference voltage transferred from the reference voltage generating unit 412, operational amplifier circuits 606 for buffering each four gray scales, that is, voltage levels corresponding to V0, v4, . . . , and V29 from the voltage levels generated by the ladder resistor 605, and an output ladder resistor 607 for generating a voltage level obtained by adding or subtracting the above-described voltage fluctuation value ΔVy. Note that the operational amplifier circuit 606 is disposed so as to prevent an output voltage of the gray scale voltage generating unit 604 from being determined by a partial voltage generated by the combined resistance of the ladder resistor 605 and the output ladder resistor 607.

As shown in FIG. 5B, the output ladder resistor 607 has a variable resistors 611 and 614 and resistors 612 and 613. The output ladder resistor 607 generates three levels through resistance division of four resistors (611 to 614) between outputs of the operational amplifier circuits 606. Among these four resistors, two resistors (611 and 614) near the outputs of the operational amplifier circuits 606 are variable resistors. Moreover, resistance values of the resistors (611 and 614) can be set in accordance with a two-bit set value stored in the inter-gray-scale-voltage adjustment register 602 as shown in FIG. 5C. For example, four types of 5R, 10R, 25R, and 50R can be set. In this case, R is a constant resistance value.

Output voltages of the output ladder resistor 607, for example, V5 to V7 can be obtained by the following expressions 2 to 4. For example, when increasing the resistance value of the variable resistor 614, terms of the portions other than (V4−V8) and +V8 of expressions 2 to 4 become a value close to 1. Therefore, it is possible to raise only V5, V6, and V7 to a high potential at the V4 side while fixing V4 level and V8 level. Moreover, when increasing the resistance value of the variable resistor 611, terms of the same portions of expressions 2 to 4 become a value close to 0. Therefore, it is possible to lower only V5, V6, and V7 to a low potential at the V8 side while fixing V4 level and V8 level. In the following, for example, r612 is assumed as the resistance value of the resistor 612.

$$V5=(V4-V8)\times(r612+r613+r614)/(r611+r612+r613+r614)+V8 \quad \text{Expression 2}$$

$$V6=(V4-V8)\times(r613+r614)/(r611+r612+r613+r614)+V8 \quad \text{Expression 3}$$

$$V7=(V4-V8)\times(r614)/(r611+r612+r613+r614)+V8 \quad \text{Expression 4}$$

Therefore, when the polarity of a voltage applied to liquid crystal is positive polarity and M="0", the signal line voltage Vdata is higher than the opposite electrode voltage Vcom and the voltage level of the signal line voltage Vdata is lowered by current leakage. Therefore, the resistance value of the variable resistor 614 is increased and the voltage fluctuation value ΔVy is added to the signal line voltage Vdata. Also, when the polarity of a voltage applied to liquid crystal is negative and M="1", the signal line voltage Vdata is lower than the opposite electrode voltage Vcom and the voltage level of the signal line voltage Vdata is raised by current leakage. Therefore, the resistance value of the variable resistor 611 is increased and the voltage fluctuation value ΔVy is added to the signal line voltage Vdata.

In this case, in FIG. 5B, resistance values r612 and r613 of the resistors 612 and 613 of the above-described four resistors are fixed to 5R. However, the configuration in which the resistances values are adjustable is also available. Also, as shown in FIG. 5C, resistance values r611 and r614 of the variable resistors 611 and 614 can be selected by two bits of the set value of the inter-gray-scale-voltage adjustment register 602. However, the number of bits is not limited to two bits. In general, although the number of switch circuits can be decreased and it is possible to reduce a circuit scale as the number of adjustment bits is decreased, since the adjustment width and adjustment accuracy are correspondingly lowered, sufficient image quality improvement effect may not be expected. Therefore, it is preferable to decide the number of adjustment bits and settable resistance value by considering the relation between the divided periods in one scanning period and the value of the impedance Rleak of the current leakage path 106 in the liquid crystal panel 401.

The comparison computing unit 608 is constituted of reversing units 609 and comparators 610. The reversing unit 609 receives low-order two bit D[1:0] of the display data D[4:0] and an M signal showing the polarity of an applied voltage from the latch circuit 411, and it transfers a signal obtained by reversing all bits of D[1:0] to the comparator 610 in the case of positive polarity and M="0" and transfers D[1:0] to the comparator 610 in the case of negative polarity and M="1". In this case, when assuming an output signal of the reversing unit 609 as C[1:0], the comparator 610 compares C[1:0] with a PH signal transferred from the timing controller 603 and outputs an EN signal which becomes "1" (high) under the condition of PH≦C[1:0] and becomes "0" (low) under the condition of PH>C[1:0]. Operations from the gray scale voltage selecting unit 417 are the same as those of the first embodiment.

Next, controls of a register and a switch in this embodiment will be described below with reference to FIG. 6A. In FIG. 6A, a reference numeral 701 denotes an ideal gray scale voltage (output voltage) and 702 denotes an output voltage of the gray scale voltage time-division output unit 415 in this second embodiment.

First, a transfer method of a line clock LP and display data D[4:0] up to the comparison computing unit 608 is the same as that of the first embodiment. Regarding the inter-gray-scale-voltage adjustment, which is a feature of the embodiments of the present invention, register values retained in the inter-gray-scale-voltage adjustment registers 602 for positive and negative polarities are transferred to the variable resistors 611 and 614 in synchronization with a switch timing of an M signal indicating the polarity of the applied voltage by the timing controller 603.

Moreover, an EN signal is generated by using a PH signal and C[1:0] which is a signal obtained by normally rotating D[1:0] at M signal="0" and reversing D[1:0] at M signal="1" in accordance with operations of the above-described comparison computing unit 608.

In this case, the 4-to-1 selector 435 sequentially selects one level from the adjacent four level gray scale voltages in accordance with a PH_M signal, and the operational amplifier circuit 436 serving as a voltage follower transfers its voltage to the gray scale voltage selecting unit 417. The voltages V0B to V7B which are the outputs of eight operational amplifier circuits 436 are changed stepwise from low voltage side to high voltage side in the case of M signal="0" and positive polarity. Moreover, the voltages V0B to V7B are changed stepwise from high voltage side to low voltage side in the case of M signal="1" and negative polarity with respect to the gray scale voltage 701 to be originally applied to the signal line (pixel electrode). Also, the feature of this embodiment lies in that each of V0B to V7B is the output voltage 702 obtained by adding a voltage fluctuation value ΔVy to the gray scale voltage 701 to be originally applied to the signal line (pixel electrode) when an applied voltage polarity is positive and that obtained by subtracting a voltage fluctuation value ΔVy from the gray scale voltage 701 when the applied voltage polarity is negative.

In FIG. 6B, a reference numeral 703 denotes the gray scale number-gray scale voltage characteristic in the gray scale voltage time-division output unit 415, in which the same characteristic as that of the case of the reference numeral 301 in FIG. 2B is obtained. As a result, it is possible to avoid streak-like image quality deterioration which occurs in the prior art.

According to the above-described circuit configuration and operation timing, the first driving method can be applied to the display device having the driver of this second embodiment even when the current leakage path 106 is inserted into the liquid crystal panel 401. Therefore, it is possible to achieve the multi-gray scale display with small steady current and small scale circuit and decrease the image quality deterioration due to the driving method.

Note that, in the second embodiment, one reference voltage generating unit 412 is provided. However, it is also possible to provide two reference voltage generating units for each polarity of an applied voltage. Moreover, it is allowed that the input display data is 6 bits, and the present embodiment can be applied to a driver not including a display memory. Furthermore, in the second embodiment, the variable resistors 611 and 614 are disposed in the gray scale voltage generating unit 604 in order to achieve the feature of the present invention. However, other circuit configuration can be used as the driver as long as the gray scale number-gray scale voltage characteristic shown in FIG. 6B can be obtained.

Third Embodiment

A configuration and operations of third embodiment will be described below with reference to FIG. 7. In the third embodiment, the above-described first embodiment is combined with RGB time-division driving in which one scanning period is divided into three periods and the three periods are allocated to the signal lines 104 (R line, G line, and B line) of the liquid crystal panel 401, so that the γ-characteristic can be individually adjusted for each of display colors R (Red), G (Green), and B (Blue) which are display colors of the liquid crystal panel 401.

FIG. 7A shows a system (liquid crystal display) including the driver of the third embodiment. FIG. 7B is a timing chart of each signal showing the control of a register and a switch in the driving method of the third embodiment.

In FIG. 7A, the control register 407 of the first embodiment is individually provided for R, G, and B. Note that configurations and operations of blocks other than the timing controller 805 and register switch circuits 806 and 807 are basically the same as those of the first embodiment. However, a RGB time-division switch 808 is added to the latter stage of the gray scale voltage selecting unit 417.

A control register 801 includes a RGB selecting period adjustment register 802 used to perform the RGB time-division driving. For the γ adjusting function, a R-line control register 407*b* and a G-line control register 803 and a B-line control register 804 having the same configuration as the R-line control register 407*b* are independently disposed.

The timing controller 805 has a dot counter and generates a line clock LP based on a dot clock inputted from outside. Also, the timing controller 805 generates a signal RSW which becomes "1" (high) in a R-line selecting period in one scanning period and becomes "0" in a R-line non-selecting period from the R-line selecting period information transferred from the RGB selecting period adjustment register 802, a signal GSW which becomes "1" (high) in a G-line selecting period in one scanning period and becomes "0" in a G-line non-selecting period from the G-line selecting period information, and a signal BSW which becomes "1" (high) in a B-line selecting period in one scanning period and becomes "0" in a B-line non-selecting period from the B-line selecting period information. Note that the signals RSW, GSW, and BSW are used by register switch circuits 806 and 807 and a RGB time-division switch 808 described later.

Also, the timing controller 805 generates a PH signal for specifying divided periods of gray scale groups in R-line, G-line, and B-line selecting periods based on the divided period information transferred from the divided period adjustment register 423. In this case, the gray scale groups mentioned here are a first gray scale group including gray scale numbers of 4n, a second gray scale group including gray scale numbers of 4n+1, a third gray scale group including gray scale numbers of 4n+2, and a fourth gray scale group including gray scale numbers of 4n+3 in 32 gray scale numbers. In this case, a PH signal is a two-bit signal which changes as 00, 01, 10, and 11 in R-line, G-line, and B-line selecting periods and is used in a gray scale voltage generating unit 414 described later. Moreover, the timing controller 805 also outputs a reverse signal /PH of a PH signal and /PH is used in the gray scale voltage time-division output unit 415.

The first register switch circuit 806 is inputted with amplitude adjustment register values of a positive first gray scale group, positive third gray scale group, negative first gray scale group, and negative third gray scale group from the R-line control register 407*b*, amplitude adjustment register values of the positive first gray scale group, positive third gray scale group, negative first gray scale group, and negative third gray scale group from the G-line control register 803, and amplitude adjustment register values of the positive first gray scale group, positive third gray scale group, negative first gray scale group, and negative third gray scale group from the B-line control register 804. Then, the first register switch circuit 806 sequentially selects the above-described register values based on RSW, GSW, and BSW generated by the timing controller 805 and the PH_1 signal similar to that of the above-described first embodiment and transfers them to the variable resistors 427 and 428 of the first reference voltage generating unit 412.

Also, the second register switch circuit 807 is inputted with amplitude adjustment register values of a positive second gray scale group, positive fourth gray scale group, negative second gray scale group, and negative fourth gray scale group from the R-line control register 407*b*, amplitude adjustment register values of the positive second gray scale group, positive fourth gray scale group, negative second gray scale group, and negative fourth gray scale group from the G-line control register 803, and amplitude adjustment register values of the positive second gray scale group, positive fourth gray scale group, negative second gray scale group, and negative fourth gray scale group from the B-line control register 804. Then, the second register switch circuit 807 sequentially selects the above-described register values based on RSW, GSW, and BSW generated by the timing controller 805 and the PH_2 signal similar to that of the above-described first embodiment and transfers them to the variable resistor of the second reference voltage generating unit 413. Note that selection order of register values will be described later with reference to FIG. 7B.

The RGB time-division switch 808 provided in the third embodiment is constituted of switches (809 to 810) as many as the number of signal lines 104 of the liquid crystal panel 401, and one ends of the switches are connected to the signal lines 104 of the liquid crystal panel 401. Also, the other ends of the R line, G line, and B line which are the adjacent signal lines 104 are connected to the same switch circuit 439. In this case, the switch circuit 809 is controlled by RSW transferred from the timing controller 805, and is turned on at RSW="1" and turned off at RSW="0". Also, the switch circuit 810 and the switch circuit 811 are similarly controlled in accordance with GSW and BSW, respectively. Consequently, the liquid crystal panel 401 can be driven through the time division of RGB. Therefore, since only one 8-to-1 selector 438 is enough for three signal lines 104 of RGB, it is possible to reduce the circuit scale.

Then, controls of a register and a switch of this third embodiment will be described below with reference to FIG. 7B. In FIG. 7B, a reference numeral 812 denotes a gray scale voltage (output voltage) to be originally applied to a signal line (pixel electrode) and 813 denotes an output voltage of the gray scale voltage time-division output unit 415 in the third embodiment.

First, RSW, GSW, and BSW are generated for the line clock LP in accordance with the R-line selecting period, G-line selecting period, and B-line selecting period set by the RGB selecting period adjustment register 802. Then, the first register switch circuit 806 changes resistance values of the variable resistors 427 and 428 in the first reference voltage generating unit 412 in accordance with the PH_1 signal generated by the timing controller 805 and RSW, GSW, and BSW signals to execute γ adjustment by means of amplitude adjustment. Similarly, the second register switch circuit 807 changes resistance values of the variable resistor in the second reference voltage generating unit 413 in accordance with the PH_2 signal generated by the timing controller 805 and RSW, GSW, and BSW signals to execute γ adjustment by means of amplitude adjustment.

A feature of this embodiment lies in that each of V0B to V7B is an output voltage 813 obtained by adding a voltage fluctuation value ΔV*y different for each of R line, G line, and B line to the gray scale voltage (output voltage) 812 to be originally applied to a signal line (pixel electrode) when an applied voltage polarity is positive and that obtained by subtracting the voltage fluctuation value ΔV*y different for each of R line, G line, and B line when the applied voltage polarity is negative.

As described above, in the third embodiment, the γ-characteristics of R, G, and B which are display colors of the liquid crystal panel 401 can be individually adjusted. Consequently, it is possible to realize a liquid crystal display capable of achieving the low power consumption and reduction in circuit scale in accordance with the gray scale time-division method, reduction in image quality deterioration by the above-described first embodiment, and higher image quality by this embodiment.

Note that, in the third embodiment, the output voltage Vx to the signal line 104 is changed stepwise from low gray scale side to high gray scale side. However, the output voltage can also be changed stepwise from high gray scale side to low gray scale side as long as the change direction of the gray scale voltage is fixed in one scanning period. Also, similar to the first embodiment, it is allowed that the input display data is 6 bits. Also, although the case where the gray scale voltage selecting unit 417 selects a voltage from adjacent gray scale voltages of four levels changed stepwise in selecting periods of the R line, G line and B line has been described, a configuration of selecting a voltage from gray scale voltages of two levels is also available. Further, the present embodiment can be applied to a driver not including a display memory. In addition, this third embodiment has been described based on the case where the RGB time-division switch 808 is disposed in the signal line driving unit 402. However, it is allowed to include a switch corresponding to the RGB time-division switch 808 in the liquid crystal panel 401. Furthermore, this third embodiment can adjust the γ-characteristic for each of R, G, and B on the basis of the configuration of the above-described first embodiment. However, it is also allowed that R, G, and B can be individually adjusted on the basis of the configuration of the above-described second embodiment.

In the foregoing, the invention made by the inventors of the present invention has been concretely described based on the embodiments. However, it is needless to say that the present invention is not limited to the foregoing embodiments and various modifications and alterations can be made within the scope of the present invention.

The present invention can be used for a display driving circuit (display driver) and a display device.

What is claimed is:

1. A display driver for a display panel which includes a signal line on one side of the panel and an opposite electrode on an opposite side of the panel, wherein a current leakage path exists between the signal line and the opposite electrode when a voltage is applied to the signal line, comprising:

a generating circuit for generating gray scale voltages corresponding to each of a plurality of gray scales; and a selecting circuit for selecting a gray scale voltage to be outputted to the signal line of the display panel in accordance with inputted display data, wherein said selecting circuit selects a gray scale voltage to be outputted to said signal line from the gray scale voltages outputted through time division from said generating circuit for each signal line and controls a length of a period for outputting the selected gray scale voltage based on said display data, said generating circuit is configured to generate the gray scale voltage whose level to an ideal voltage is fluctuated due to charge transfer through the current leakage path in accordance with each of a plurality of periods obtained by time-division of one scanning period for outputting said gray scale voltage to said signal line, and said generating circuit generates the gray scale voltages whose levels differ in each divided period, which are obtained by adding or subtracting voltage fluctuation values corresponding to the charge transfer through the current leakage path to/from said gray scale voltage in each of the time-divided periods.

2. The display driver according to claim 1, wherein said generating circuit outputs a gray scale voltage in which said level is fluctuated stepwise from a high-potential gray scale voltage to a low-potential gray scale voltage or from a low-potential gray scale voltage to a high-potential gray scale voltage from among said gray scale voltages.

3. The display driver according to claim 1, wherein said generating circuit has a ladder resistor for dividing a reference voltage and variable resistors located between said ladder resistor and said reference voltage.

4. The display driver according to claim 3, further comprising:

adjustment registers for adjusting the resistance values of said variable resistors.

5. The display driver according to claim 4, wherein said adjustment register sets an amplitude on a graph of a relation between a gray scale number and a gray scale voltage.

6. The display driver according to claim 5, further comprising:

said adjustment registers as many as the number of time-divided periods of said the one scanning period; and switch circuits for sequentially selecting set values stored in said adjustment registers.

7. The display driver according to claim 6, wherein said switch circuits transfer the set values stored in said adjustment registers to said variable resistors at the timing of time division.

8. A display driver for a display panel which includes a signal line on one side of the panel and an opposite electrode on an opposite side of the panel, wherein a current leakage path exists between the signal line and the opposite electrode when a voltage is applied to the signal line, comprising:

a generating circuit for generating gray scale voltages corresponding to each of a plurality of gray scales; and a selecting circuit for selecting a gray scale voltage to be outputted to the signal line of the display panel in accordance with inputted display data, wherein said selecting circuit selects a gray scale voltage to be outputted to said signal line from the gray scale voltages outputted through time division from said generating circuit for each signal line and controls a length of a period for outputting the selected gray scale voltage based on said display data, said generating circuit is configured to generate the gray scale voltage whose level to an ideal voltage is fluctuated due to charge transfer through the current leakage path in accordance with each of a plurality of periods obtained by time-division of one scanning period for outputting said gray scale voltage to said signal line, and said display driver includes means for outputting gray scale voltages whose levels differ in each divided period by performing level adjustment or conversion to the gray scale voltages generated by said generating circuit in accordance with voltage fluctuation values corresponding to the charge transfer through the current leakage path in each time-divided period in said signal line.

9. A display driver for a display panel which includes a signal line on one side of the panel and an opposite electrode on an opposite side of the panel, wherein a current leakage path exists between the signal line and the opposite electrode when a voltage is applied to the signal line, comprising:

a generating circuit for generating gray scale voltages corresponding to each of a plurality of gray scales; and a selecting circuit for selecting a gray scale voltage to be outputted to the signal line of the display panel in accordance with inputted display data, wherein said selecting circuit selects a gray scale voltage to be outputted to said signal line from the gray scale voltages outputted through time division from said generating circuit for each signal line and controls a length of a period for outputting the selected gray scale voltage based on said display data, said generating circuit is configured to generate the gray scale voltage whose level to an ideal voltage is fluctuated due to charge transfer through the current leakage path in accordance with each of a plurality of periods obtained by time-division of one scanning period for outputting said gray scale voltage to said signal line, said display driver divides said scanning period into three periods and performs the driving in combination with a driving method in which the three periods are allocated to R line, G line, and B line corresponding to display colors, which are the signal lines of said display panel, and said display includes means for outputting gray scale voltages whose levels differ in each divided period, which are obtained by adding or subtracting voltage fluctuation values corresponding to the charge transfer through the current leakage path to/from a gray scale voltage generated in said generating circuit each time-divided period in said signal line for each of R, G, and B.

10. A display driver according to claim 1 for outputting a voltage corresponding to externally provided display data to a display panel, further comprising:

an output circuit for outputting a voltage which is changed stepwise in accordance with the divided periods in one horizontal period; and a circuit for shifting the level of said voltage changed stepwise for each divided period.

11. A display driver according to claim 1 for outputting a voltage corresponding to externally provided display data to a display panel, further comprising:

an output circuit for outputting a voltage which is changed stepwise in accordance with the divided periods in one horizontal period;

a setting circuit for setting the level of said voltage changed stepwise for each divided period.

* * * * *